United States Patent [19]

Mazzola

[11] Patent Number: 4,800,037

[45] Date of Patent: Jan. 24, 1989

[54] PROCESS FOR MAKING A HEAVY DUTY LIQUID DETERGENT COMPOSITION

[75] Inventor: Louis R. Mazzola, Mahwah, N.J.

[73] Assignee: Lever Brothers Company, New York, N.Y.

[21] Appl. No.: 58,298

[22] Filed: Jun. 5, 1987

[51] Int. Cl.[4] ..... C11D 9/10; C11D 15/09

[52] U.S. Cl. ..... 252/109; 252/106; 252/107; 252/121; 252/173; 252/110; 252/174.11; 252/174.19; 252/539; 252/558; 252/540; 252/559

[58] Field of Search ..... 252/156, 121, 132, 173, 252/174.19, 524, 543, DIG. 14, 109, 110, 106, 107, 121, 173, 174.11, 174.19, 539, 558, 559, 540

[56] References Cited

U.S. PATENT DOCUMENTS

| | | | |
|---|---|---|---|
| 2,859,182 | 11/1958 | Carroll | 252/137 |
| 2,994,665 | 8/1961 | Reich et al. | 252/137 |
| 3,629,125 | 12/1971 | Payne, Jr. et al. | 252/135 |
| 3,707,503 | 12/1972 | Kenny | 252/117 |
| 3,958,928 | 5/1976 | Lala | 8/25 |
| 3,970,575 | 7/1976 | Barrett, Jr. | 252/95 |
| 4,077,911 | 3/1978 | Okumura et al. | 252/550 |
| 4,110,238 | 8/1978 | Lala | 252/89 |
| 4,144,024 | 3/1979 | Lala | 8/25 |
| 4,144,226 | 3/1979 | Crutchfield et al. | 528/231 |
| 4,304,679 | 12/1981 | Hooper et al. | 252/106 |
| 4,462,922 | 7/1984 | Boskamp | 252/174.12 |
| 4,526,701 | 7/1985 | Rubin | 252/113 |
| 4,532,064 | 7/1985 | Boskamp | 252/105 |

FOREIGN PATENT DOCUMENTS

| | | |
|---|---|---|
| 47-022473 | 6/1971 | Japan . |
| 47-212100 | 1/1982 | Japan . |
| 57-205500 | 12/1982 | Japan . |
| 60-130697 | 7/1983 | Japan . |
| 85-51795 | 8/1983 | Japan . |
| 58-187499 | 11/1983 | Japan . |
| 86-60797 | 8/1984 | Japan . |
| 61-287996 | 12/1986 | Japan . |

*Primary Examiner*—Paul Lieberman

*Attorney, Agent, or Firm*—James J. Farrell; Matthew J. McDonald

[57] ABSTRACT

A heavy duty detergent composition of a solvent, an anionic detergent component in acid form, a fatty acid, an alkali metal hydroxide, a nonionic detergent, a hydrotrope, a buffering agent, a dye and a builder mixed by adding substantially all of the solvent to the vessel, and adding the remaining components in any order so long as the builder is added to the vessel prior to neutralization of the anionic detergent from acid to salt form by the alkali metal hydroxide. The builder alone prevents degradation of the dye color or a chelating agent and the builder may be employed to prevent color degradation. When added in solution, the chelating agent or the builder increases the volume of the vessel mixture. Heat released in neutralization is absorbed by a larger volume of liquid. Neutralization thus does not raise the temperature of the components in the vessel as high as if chelator or builder solution were added later. Neutralization may be performed more quickly and batch processing times may be reduced.

11 Claims, No Drawings

PROCESS FOR MAKING A HEAVY DUTY LIQUID DETERGENT COMPOSITIONThis invention relates to the process for making heavy duty liquid detergent compositions and particularly to the order of addition of the components thereof.

BACKGROUND OF THE INVENTION

Heavy duty liquid detergent compositions are generally comprised of a solvent and one or more of the following: an anionic detergent component, alkali metal hydroxide, a nonionic detergent component, fatty acid, a hydrotrope, a dye, a builder and a buffering agent such as an alkanolamine or sodium silicate. Optonally, a perfume and opacifier may be incorporated.

The mixing and order of addition of these components has conventionally been as follows. Most of the solvent is introduced into a vessel. Each of the following components is then added in the order listed with moderate stirring; as soon as the addition of one component is complete, addition of the next begins.

Dye
Hydrotrope
Alkali Metal Hydroxide
Anionic Detergent (acid form)
Nonionic Detergent, Fatty Acid
Builder
Buffering Agent
Opacifier
Perfume
Solvent (remaining)

The contents of the vessel after addition of any of these ingredients to the water is referred to herein as the "vessel mixture".

Sufficient alkali metal hydroxide is added to the vessel mixture to convert the anionic detergent (acid form) to the salt form and the fatty acid to soap when these components are added in their separate addition steps. "Neutralization" is the name in this specification for the process step in which the anionic detergent component is converted from the acid to the salt form. (Soap formation is not considered part of "neutralization", mainly because much more detergent than fatty acid is neutralized.)

Neutralization may be accomplished by adding the alkali metal hydroxide to a vessel mixture already containing the anionic detergent (acid form) of the batch. However, the unneutralized acid form may corrode the vessel and its mixing means. Also, addition of the hydroxide to the detergent in acid form may produce gummy solids which are difficult to dissolve. Both these problems are avoided by instead adding the anionic detergent (acid form) component to the vessel mixture already containing the alkali metal hydroxide.

Neutralization is exothermic. When the detergent composition is made in large batches, e.g. of 100,000 lbs. and more, the potential for heat release is very large. The heat release accompanying neutralization raises the temperature of the entire aqueous mixture in the mixing vessel. Care must be taken not to exceed the temperature limits of the vessel mixture of any of its 25 components. A temperature maximum of 130°-150° F. or 135°-145° F. applies to the process. The temperature of the mixture is maintained below the maximum by a controlled rate of addition of the anionic detergent in acid form to the aqueous mixture, preferably with interruptions in the addition to allow the mixture to cool.

It has been noted that the above liquid detergent compositions do not always retain their color. In fact, the process of mixing the composition components often seems to affect the dyes adversely: the blue and/or violet color of these compositions may be pale at the end of component mixing and even before storage may be a muddy steel grey. This color degradation may continue and worsen during storage, but this degradation of color is apparent in those batches showing it immediately upon completion of mixing the batch. Adding the dye to the vessel mixture after (instead of before) the neutralization step does not prevent color degradation.

One successful response to the degradation of color has been to add extra colorant to the composition after neutralization. This solution however is unattractive because it adds expense to the process and lengthens it: extra time is needed to add and dissolve the extra dye and to perform a color matching process between each batch and a standard color sample.

SUMMARY OF THE INVENTION

The detergent composition made under this invention is comprised of an anionic detergent, a nonionic detergent, a fatty acid, a hydrotrope, a builder, a solvent, a dye, and optionally opacifiers, a buffering agent, perfumes, chelating agents, soil suspending agents, enzymes and Deodorant Compositions. The color of some batches of this composition was found to degrade immediately after mixing. Analytical tests were performed to see if there were more attractive solutions to the problem of color degradation than use of extra dye.

The analytical tests focused first on what caused color degradation. It was discovered that the color of several of the substituted anthraquinone dyes used in the detergent compositions has great sensitivity to the presence of copper and iron ions: color degradation may occur with as little as 10 parts per million (ppm) iron or copper ion in the composition.

The analytical tests next focused on methods of controlling the effect of these ions. From these tests, it was discovered that color may be preserved if the dye and a chelating agent are both incorporated in the vessel mixture before neutralization. Surprisingly, addition of either the chelating agent alone or both the dye and chelating agent to the vessel mixture after neutralization does not preserve color. The use of a chelating agent to preserve color obviates the need for extra dye in the composition.

The builders incorporated in the heavy duty liquid detergent components are generally poor chelators for iron and copper ions. However, the builder component of the heavy duty liquid compositions may constitute up to 15% of the heavy duty detergent compositions. With such a bulk of builder material, it is found the builder prevents color degradation if added, as the chelator is, prior to neutralization. As long as a builder or a chelator, if one is used, is added prior to neutralization, the dye may be added at any point in the process without substantial adverse effect.

The chelator or builder may be added to the vessel mixture as a solid (e.g. in salt form) or as an aqueous solution of from 15-75% by weight, or alternatively from 35-45% by weight of chelator or builder.

When the builder is added as a solution to the vessel mixture prior to neutralization, one unexpected benefit is that the vessel mixture heats up less during subsequent neutralization. Consequently, the rate of adding the anionic detergent (in acid form) may be faster and the entire neutralization step may proceed substantially more quickly than under the old process. Addition of the builder as a solution prior to neutralization shortens batch process time in two ways: (i) the addition of extra colorant with color matching of batches becomes unnecessary and (ii) the time required for the neutralization step is shortened.

DETAILED DESCRIPTION OF THE INVENTION

The heavy duty liquid detergent composition made in the process of the present invention is comprised of the following components.

TABLE I

| | |
|---|---|
| Anionic Detergent (acid form) | 1–20% |
| Nonionic Detergent | 3–15% |
| Hydrotrope | 4–9% |
| Fatty Acid | 0.025–2% |
| Builder | 5–15% |
| Dye | 0.0005–0.025% |
| Solvent | balance |

The solvent of the composition may be water or more particularly demineralized water, i.e. water from which substantially all magnesium and calcium ions have been removed. Water may be demineralized in conventional ways, including treatment with ion exchange resins or zeolite particles. The solvent may alternatively be an aqueous solvent system incorporating from 1–25% by weight of an alkanol of from 1 to 6 carbon atoms, any of which may be alkoxylated with from 1 to 8 alkoxy residues, each residue having 1 to 4 carbon atoms.

The anionic detergent component of the composition may be selected from the group consisting of the acid forms of those described at col. 3, lines 24–51 of U.S. Pat. No. 3,707,503 which patent is hereby incorporated by reference. The anionic detergent component may also be a paraffin sulfonate of the secondary n-alkane sulfonate type. The paraffin fraction of such surfactants may have chains with 10–24 carbon atoms, or more particularly 13–17 carbon atoms. The surfactant in acid form may be added to the vessel mixture in a solution of from 20–95% by weight. Neutralization converts the anionic detergent component to salt form as described above.

The hydrotrope includes those described at col. 3, lines 52–61 in U.S. Pat. No. 3,707,503. The nonionic detergent component includes primary alcohols with from 9 to 16 carbon atoms, condensed with from 0 to 4 moles of ethylene oxide, and mixtures of such ethoxylated alcohols. Other suitable nonionic surfactants are those set forth at col. 4, lines 4–11 of U.S. Pat. No. 3,707,503. The buffering component includes the compounds described in U.S. Pat. No. 2,859,182 which patent is hereby incorporated by reference.

The builder component includes organic and inorganic builders. Suitable inorganic builders include water-soluble salts of phosphates, pyrophosphates, polyphosphates, carbonates and the like. Specific examples of inorganic phosphate builders include tetrasodium and -potassium pyrophosphates and hexametaphosphates. Organic builders include gluconic acid, citric acid, dihydroxyethyl glycine, succinates, carboxylates, polycarboxylates and alkali metal salts thereof. Further organic builders are water-soluble phosphonates, polyphosphonates, polyhydroxysulfonates, polyacetates and polyhydroxysulfonates. The organic polyphosphonates specifically include, for example, the sodium and potassium salts of ethane 1-hydroxy-1, 1-disphosphonic acid and the sodium and potassium salts of ethane-1,1,2-triphosphonic acid. Other suitable builders include the polyacetal carboxylate builders described in U.S. Pat. No. 4,144,226, incorporated herein by reference.

The fatty acid soap component is selected from the group consisting of natural and synthetic fatty acids having 8 to 20 carbon atoms or mixtures of such fatty acids, such as are derived from animal and vegetable fats and oils, as well as those disclosed at col. 4, lines 12–43 of U.S Pat. No. 3,707,503. Neutralization converts the fatty acid component to soap (an alkali metal or ammonium or substituted ammonium salt of the fatty acid) as described above.

The dye component of the detergent composition is intended to provide an esthetically pleasing product of desirable color value. The dye component is drawn from the class of subsituted anthraquinones suitable for use in heavy duty liquid detergent compositions and may include those dyes disclosed at col 1, line 61 –col. 2, line 68 of U.S. Pat. No. 4,144,024, which patent is hereby incorporated by reference, as well as Acid Violet 48. Each of these dyes may be used alone or with one or more of the others. Suitable dyes include Acid Blue 80, Acid Blue 145, Acid Violet 48 and Solvent Blue 58 as defined in the *Colour Index*, 3rd Ed., Society of Dyers and Colourists, 1971, Bradford, England. It is understood that this list merely illustrates and does not limit the dyes which may be incorporated into the liquid detergent composition.

In addition, buffering agents such as alkanolamines or alkali metal silicates may optionally be added in the amount of 2–15% by weight of the composition. When a water-soluble alkali metal silicate is added to the composition, the pH thereof must be adjusted to about 11.2 or above, preferably greater than 11.4, by the addition of free alkali to keep the silicate in solution. Typical alkali metal silicates include the sodium or potassium silicates having the following alkali silica ratios: 1:3.92, 1:3.45, 1:2.4, 1:1.8, 1:2.5 and 1:2.0. An amount up to about 6% on a solids basis of the silicate may be employed.

The heavy duty liquid detergent composition may optionally also incorporate one or more chelating agents in the amount of 0.05–5% by weight of the composition. The composition may also comprise a total of from about 0.1–3% by weight of a pair of soil suspending cellulose derivatives described at col. 5, line 2 –col. 6, line 40 in U.S. Pat. No. 2,994,665 which patent is hereby incorporated by reference. Another optional ingredient of the detergent composition is 0.01–10% by weight of "Deodorant Compositions" which inhibit development of body malodor as described in U.S. Pat. No. 4,304,679, hereby incorporated by reference. Detergent compositions may also optionally incorporate enzymes such as the proteolytic, amylolytic or cellulolytic enzymes described in U.S. Pat. Nos. 4,462,922 and 4,532,064, (both incorporated by reference herein) in the amount of 0.01–10% by weight. It may be preferable to add these components to the vessel mixture after the neutralization step. Addition prior to that step exposes these optional components to the higher temperatures and pH swings of the neutralization step, which may possibly deactivate some of each component. Additionally, it is desirable to add the Deodorant Compositions to the detergent composition at a stage towards the end of its mixing in the vessel so that loss of any volatile ingredients of the Deodorant Compositions such as may occur due to heating of the vessel mixture is minimized.

Some batches of the heavy duty liquid detergent composition produced under the conventional process undergo a change in color as soon as the batch is complete. The desired blue-violet color has a muddy greyish cast at the end of mixing the composition. The color may initially be quite different from the desired one, or slightly off and worsening over time. Either way, color degradation was immediately apparent upon completion of mixing. Analytical tests were performed on these batches to determine whether contaminants in the composition were responsible for color degradation. Levels of copper and iron ions were found to be as high as 34.8 ppm in these discolored batches.

Batches of the detergent composition were made and dosed with copper and iron to determine whether color degradation was associated with the presence of these ions. The following test results establish that color degradation is associated with the presence of copper and iron ions in the composition. (It is not known whether these metal ions directly interact with the dye or co-act with another composition component or contaminant to degrade color.)

TABLE II

| Heavy Duty Liquid Detergent Composition Batch # | Dosed Metal Contamination (ppm) Iron | Copper | Color/Comments |
|---|---|---|---|
| 1 | — | — | Excellent |
| 2 | 35 | — | Poor |
| 3 | 10 | 10 | Significant color degradation |
| 4 | 35 | 10 | Duplicates color of worst batches |

Further tests indicated that some components of the detergent composition contained up to 37.5 parts per million of iron and 1.0 part per million of copper ion. Despite the high levels of metal contamination discovered in these components, these components contributed only up to about half of the iron and copper in the composition. The remainder of the metal contamination had other sources, possibly the pipes and vessels through which the components passed. Given the difficulty of eliminating contamination from these sources, effort was turned to limiting the effect of the metal contaminants present in the composition.

It was discovered that addition of one or more chelating agents in the process can prevent color degradation and remove the need for adding extra colorant. Chelating agents which perform well include the tetraalkali metal or partial alkali metal salts of ethylenediaminetetraacetic acid (EDTA); alkali metal salts of triethanolamine (TEA), nitrilotriacetic acid (NTA), and carboxymethyloxy succinic acid or mixtures of the above. (Tetrasodium EDTA is available commercially as Versenee, which has 39% solids, ex Dow Chemical Company, Midland, Mich., U.S.A.) These chelating agents may be added to the vessel mixture as solids, e.g. as crystalline salts, or, if convenient, in solution. The amount of chelating agent incorporated in the composition is from 0.05–5% by weight or alternatively 0.1–3% by weight.

The following test results demonstrate the effectiveness of chelating agents in preserving composition color.

TABLE III

| Heavy Duty Liquid Composition Batch # | Dosed Metal Contamination (ppm) Iron | Copper | Chelating Agent (% wt.) | Color |
|---|---|---|---|---|
| 1 | — | — | — | Control |
| 2 | 10 | 10 | 1% Versene | Very close to control |
| 3 | 35 | 10 | 1% Versene | Close to control |
| 4 | 35 | — | 0.0585% Versene | Nearly as good as control |
| 5 | 35 | 1 | 0.30% TEA | Good |
| 6 | 35 | 1 | 0.15% TEA | Acceptable |
| 7 | 35 | 1 | 0.15% Versene 0.20% TEA | Excellent |
| 8 | 35 | 1 | 0.0585% Versene 0.30% TEA | Excellent |
| 9 | 35 | — | 0.0585% Versene 0.30% TEA | About equal to control |
| 10 | 35 | 1 | 0.04% Versene 0.02% TEA | Borderline |

The use of Versene at 0.0585% (solids) and 0.30% TEA was favored as the most viable solution to the color problem. One aspect of the present invention is the discovery that color degradation may be prevented by adding one or more chelating agents to the vessel mixture in the amount of at least 0.05% by weight of the composition. The composition may contain as much as 5% by weight of one or more chelating agents without detriment, but it is believed that using more than 2.5% by weight provides no increased benefit.

By preventing color degradation, addition of the chalating agent saves the time and expense of adding extra dye to the composition. However, the chelating agent raises the cost of the composition; also, the time required for its addition may offset the time saved from omitting extra dye. Further work was therefore performed on preserving of the composition color.

It was known that sodium citrate has only weak chelating ability towards iron and copper ions. Nevertheless, the following tests were run to determine whether the builder component of the composition might contribute to color stability. The entire sodium citrate component is added to the vessel immediately after the initial water charge.

TABLE IV

| Heavy Duty Liquid Detergent Batch # | Dosed Metal Contamination (ppm) Iron | Copper | Chelating Agent (% wt.) | Color |
|---|---|---|---|---|
| 1 | — | — | — | Control |
| 2 | 35 | — | 0.0585% Versene 0.30% TEA, and sodium citrate | Possibly better than control |
| 3 | 35 | — | sodium citrate | Acceptable |
| 4 | 35 | — | sodium citrate | Acceptable |

These test results demonstrate that, despite its generally poor ability for chelating copper and iron ions, sodium citrate alone provides some protection for composition color.

Thus, another aspect of this invention is the discovery that a builder, alone or with one or more chelating agents, may contribute to the prevention of color degradation (cf. Table II, Batch 9).

Table III shows that higher levels of one or more chelating agents better protect against color degradation (compare Batches 2 and 4; Batches 5 and 6; Batches 7 and 10). Table IV shows that two chelating agents and one builder protect color better than the builder alone. Without in any way limiting the scope of the invention, applicant believes these results indicate that both the chelating agents and, to a lesser extent, the builder used in this invention sequester iron and copper ions and that limiting or preventing exposure of the dye to these ions preserves the composition color. It would follow from this that the chelator and dye (or chelating agent and builder and dye) could be added one after the other at any time in the process; color would be preserved as long as the chelator had already sequestered the copper and iron ions, or if it sequestered the ions before they had affected the dye. To some extent, this is so. Thus, when the chelator is added prior to neutralization and the dye after neutralization, color is preserved. Also when the dye is the first component added to the initial vessel water charge and the chelator is the last component added before neutralization, color is preserved.

However, when the builder sodium citrate is used alone to prevent color degradation and is added after neutralization but prior to the dye, color degradation does occur. No degradation is expected because the builder is believed to sequester the iron and copper ions and to prevent the ions from affecting the dye. But the neutralization step appears to reduce the ability of these compounds to prevent color degradation. Thus, a further aspect of this invention is that when one or more chelating agents are used to preserve composition color, at least one of them must be added to the vessel mixture prior to neutralization. Also, when one or more chelating agents and one builder are employed in the composition, at least one of the chelating agents or the builder must be added prior to neutralization. Finally, when the builder alone is to prevent color degradation, it is to be added to the vessel mixture before neutralization.

Substantially, the entire amount of builder (5–15% by weight of the composition) or of the chelating agent (0.05–5% by weight of the composition) ought to be added to the vessel mixture before neutralization. At least 0.05% of a chelating agent is needed to help prevent color degradation. The minimum for a builder is 5% by weight. Less than 5%, e.g. 1%, added before neutralization would not preserve a sufficient amount of the dye to maintain the composition color.

Just as important as the discovery that sodium citrate alone may preserve color is the fact that use of the builder alone does not increase the cost of the composition or lengthen process batch time. In fact, use of builder alone may significantly shorten the process batch time. This shortening of process time results from adding the builder to the vessel mixture in solution.

In a preferred embodiment, the builder of the composition is added to the vessel as an aqueous solution of from 25 to 55% by weight, or alternatively from 35–45% by weight. When the builder is sodium citrate dihydrate, it may be added as a 40% solution. In a 1000 lb. batch, the sodium citrate solution constitutes 250 lbs. thereof.

Addition of the builder solution to the vessel mixture shortens process time by allowing a more rapid neutralization step. Conventionally, the anionic detergent component is added incrementally with intervals for cooling the vessel mixture. As Table V illustrates, the weight of the conventional vessel mixture just prior to neutralization is 372.9 lbs. (asterisk). In the new process, addition of the builder solution prior to neutralization substantially increases the volume of the vessel mixture in which the anionic detergent is to be neutralized. This pre-neutralization weight in the new process is 622.9 lbs. (asterisk); this is 245 lbs. (or about two-thirds) more than the pre-neutralization vessel mixture weight under the old process.

TABLE V

| OLD PROCESS | | | NEW PROCESS | | |
|---|---|---|---|---|---|
| Component Added (Lbs.) | | Cumulative Lbs. | Component Added (Lbs.) | | Cumulative Lbs. |
| Initial Water Charge | (200) | 200 | Initial Water Charge | (200) | 200 |
| Dye | (0.1) | 200.1 | Dye | (0.10) | 200.1 |
| Hydrotrope | (125) | 325.1 | Hydrotrope | (125) | 325.1 |
| NaOH, 49% Soln. | (47.8) | *372.9 | Sodium Citrate, 40% Soln. | (250) | 575.1 |
| Alkylbenzene sulfonic acid | (167.3) | 540.2 | NaOH, 49% Soln. | (47.8) | *622.9 |
| Nonionic Detergent - 70 | (118.3) | 658.5 | Alkylbenzene sulfonic acid | (167.3) | 790.2 |
| Fatty Acid - 0.8 | | | Nonionic Detergent - 70 | (118.3) | 908.5 |
| Hydrotrope - 27.5 | | | Fatty Acid - 0.8 | | |
| Alkanolamine - 20 | | | Hydrotrope - 27.5 | | |
| Opacifier - 2.7 | (32.7) | 691.2 | Alkanolamine - 20 | | |
| Water - 30 | | | Opacifier - 2.7 | (32.7) | 946.2 |
| Sodium Citrate, 40% soln. | (250) | 941.1 | Water - 30 | | |
| Water | (57.2) | 998.4 | Water | (57.2) | 998.4 |
| Perfume | (1.5) | 999.9 | Perfume | (1.5) | 999.9 |

*Vessel mixture weight just before neutralization.

The temperature of the vessel mixture does not rise as high under the new process during neutralization as under the old because the heat of neutralization is dispersed in 622.9 lbs. of vessel mixture, as opposed to 372.9 lbs. under the old process. There is more vessel mixture to absorb the heat released in neutralization in the new process. Consequently, the temperature of the vessel mixture rises less.

An important corollary of this lower temperature rise is that one may add the anionic detergent in acid form at a faster controlled rate while still maintaining the mixture temperature below 130°–150° F. Under the old process, in batches of over 150,000 lbs, the incremental addition of the anionic detergent (acid form) conventionally required about an hour. By contrast, this time is halved under the new process. The addition of the anionic detergent component to the vessel mixture is still incremental (i.e. interrupted to avoid heating the vessel mixture above 130°–150° F., or above 135°–145° F.; but the interruptions may be abbreviated or the greater amounts of anionic detergent may be added before an interruption. Thus, the neutralization step may be performed much more quickly under the new process than the old.

This faster neutralization achieves a significant time savings. Making heavy duty liquid detergent composition batches of over 150,000 lbs. conventionally required 4.75 hours, of which addition ofthe anionic detergent in acid form took 1 hour and addition of the extra dye with color matching took 20 minutes. Adding the builder as a solution prior to neutralization eliminates the need for extra dye, saving 20 minutes (0.33 hr.). Also, early addition of the builder allows the 1 hr. addition time for alkylbenzene sulfonic acid to be halved. Net time saved is 0.83 hr., or 14% of the time for the conventional process.

Thus, addition of the builder in solution form to the vessel before neutralization provides a triple benefit (i) the color of the composition is preserved; (ii) the time and expense of adding extra colorant and matching batches to a standard is avoided; and (iii) the time to process each batch is shortened by adding anionic detergent in the acid form more quickly to the vessel mixture.

Applicant believes that premixing the builder with either the alkali metal hydroxide or the anionic detergent in acid form, such that the builder is added during the neutralization step, would be impractical. Addition of the hydroxide to a vessel mixture containing the acid anionic detergent risks forming gummy, insoluble solids. And while adding the anionic to hydroxide already in the vessel mixture avoids this risk, a premix of the anionic detergent and the builder is itself likely to form a jelly mass difficult to disperse in the vessel mixture.

For a further understanding of the invention, reference may be made to the following Examples.

The components of Examples 1–4 are added to a vessel in the order indicated with continuous moderate mixing. Addition of each component begins as soon as the addition of the preceding component is complete. The amount of each component in Table VI is in weight by pounds (lbs.). The final pH of each 1,000 lb. batch is adjusted with sodium hydroxide or sulfuric acid to 11.4±0.2.

TABLE VI

| | Example # | | | |
|---|---|---|---|---|
| | 1 | 2 | 3 | 4 |
| Demineralized Water | 200.00 | 200.00 | 225.00 | 225.00 |
| Acid Violet 48 | | 0.10 | | |
| Acid Blue 80 | | 0.03 | | 0.05 |
| Acid Blue 145 | 0.10 | | 0.02 | |
| Solvent Blue 58 | | | 0.05 | 0.2 |
| Sodium ethyl benzene sulfonate 40% active | 125.00 | | 125.00 | |
| Sodium xylene sulfonate, 40% active | | 125.00 | | 125.00 |
| Tetrapotassium pyrophosphate, 40% solution | 250.00 | | 250.00 | |
| Sodium Citrate Dihydrate, 40% solution | | 250.00 | | 250.00 |
| NaOH, 49% solution | 45.00 | 47.78 | 50.00 | 45.18 |
| Dodecyl Benzene Sulfonic Acid, 95% active | 165.00 | 167.34 | | |
| Octadecyl Sulfonic Acid, 95% active | | | 170.00 | 165.00 |
| *Neodol 25-9 | 70.00 | 70.00 | 70.00 | 65.00 |
| Sodium ethyl benzene sulfonate, 40% active | 25.00 | | 25.00 | 25.00 |
| Sodium xylene sulfonate, 40% active | | 27.54 | | |
| *Stearic Acid | | 0.75 | 0.75 | |

TABLE VI-continued

| | Example # | | | |
|---|---|---|---|---|
| | 1 | 2 | 3 | 4 |
| *Lauric Acid | 1.4 | | | 1.2 |
| Monoethanolamine | | 20.00 | 20.00 | |
| Diisopropanolamine | 20.00 | | | 20.00 |
| Opacifier | 3.00 | 2.75 | 3.00 | 2.55 |
| Demineralized Water | 99.00 | 87.21 | 35.00 | 80.00 |
| Perfume | 1.50 | 1.50 | .95 | 1.0 |
| Total Lbs. | 1,000.00 | 1,000.00 | 1,000.00 | 1,000.00 |

*Nonionic detergent and fatty acid are added together.

EXAMPLE 5

A batch of the heavy duty liquid fabric washing detergent composition totaling 150,000 lbs. is made by adding 150 times the amount of each component indicated in Example 3. The nonionic detergent, hydrotrope, fatty acid and alkanolamine components may be combined into and added to the vessel as a premix; so may the opacifier and 20–50% of the final water charge. The nonionic premix is added after the sodium hydroxide and the opacifier premix after the nonionic premix.

EXAMPLE 6

The components of Example 4 are mixed in the order of Example 4 with the exception that the sodium citrate dihydrate (250 lbs.) is added immediately after the initial water charge. The composition further comprises 2 lbs. of the "Deodorant Composition" set forth in Example I of U.S. Pat. No. 4,304,679, which Deodorant Composition is added to the vessel mixture after the opacifier. The final water charge is reduced to 78 lbs.

EXAMPLE 7

The components of the batch of Example 2 are mixed in the order of Example 2, and further 1 lb. of the proteolytic enzyme Savinasee ® is added to the vessel after the opacifier. The final water charge is reduced to 86.21 lbs.

Each of the heavy duty liquid detergent compositions resulting from Examples 1–7 has the desirable blue-violet color upon completion of the process; this color is not degraded after 2 weeks of storage.

As will be readily apparent to persons of ordinary skill in the art to which the present invention pertains, various modifications of such invention as hereinbefore set forth and as further defined in the appended claims may be made without departing from the spirit and scope thereof and regardless of the applicability of the theoretical bases advanced herein to elucidate the invention.

What is claimed is:

1. A process of mixing a color-stable heavy duty liquid detergent composition from a solvent component, an anionic detergent component in acid form, a fatty acid component, an alkali metal hydroxide component, a nonionic detergent component, a hydrotrope component, a builder component and a dye component, the process comprising:

(a) adding substantially all the solvent to a vessel, (b) adding at least one component of the composition to the vessel to form a vessel mixture, (c) neutralizing the anionic detergent in acid form to a salt form by combining in the vessel mixture the anionic detergent in acid form with the alkali metal hydroxide, and (d) adding the remaining components to the vessel mixture in any order so long as the builder component is added to the vessel prior to neutralization of the detergent to salt form by the alkali metal hydroxide.

2. A process according to claim 1 wherein the builder component is added to the vessel mixture as a 35–45% by weight solution.

3. A process according to claim 1 further comprising adding a chelating agent in the amount of 0.05–5% by weight of the composition to the vessel mixture prior to neutralization.

4. A process according to claim 4 wherein the chelating agents are selected from the group consisting of triethanolamine, and salts thereof; nitrilotriacetic acid and salts thereof; carboxymethyloxysuccinic acid and salts thereof; and ethylenediaminetetraacetic acid and the partial and tetraalkali metal salts thereof; and mixtures thereof.

5. A process according to claim 1 where the composition further comprises a buffering agent.

6. A process according to claim 5 where the buffering agent is selected from the group consisting of alkanolamines and alkali metal silicates.

7. A process according to claim 2 wherein the dye is also added to the vessel prior to neutralization.

8. A process according to claim 1 wherein the dye is selected from the group consisting of Acid Violet 48, Acid Blue 80, Acid Blue 145, Solvent Blue 58 and mixtures thereof.

9. A process according to claim 1 further comprising adding 0.1–3% by weight of a pair of soil suspending agents to the vessel mixture.

10. A process according to claim 1 further comprising adding 0.01–10% by weight of a Deodorant Composition to the vessel mixture.

11. A process according to claim 1 further comprising adding 0.01–10% by weight of an enzyme to the vessel mixture, the enzyme being selected from the group consisting of proteolytic, amylolytic, and cellulolytic enzymes and mixtures thereof.

* * * * *